United States Patent [19]

Tufano et al.

[11] Patent Number: 4,804,621

[45] Date of Patent: Feb. 14, 1989

[54] PROCESS FOR THE PREPARATION OF TABULAR SILVER CHLORIDE EMULSIONS USING A GRAIN GROWTH MODIFIER

[75] Inventors: Thomas P. Tufano; Dominic M. Chan, both of Wilmington, Del.

[73] Assignee: E. I. Du Pont de Nemours and Company, Wilmington, Del.

[21] Appl. No.: 42,714

[22] Filed: Apr. 27, 1987

[51] Int. Cl.[4] ..... G03C 1/02; G03C 1/76

[52] U.S. Cl. ..... 430/567; 430/569

[58] Field of Search ..... 430/567, 569

[56] References Cited

U.S. PATENT DOCUMENTS

| | | | |
|---|---|---|---|
| 4,399,215 | 8/1983 | Wey | 430/567 |
| 4,400,463 | 8/1983 | Maskasky | 430/434 |
| 4,434,226 | 2/1984 | Wilgus et al. | 430/569 |
| 4,610,958 | 9/1986 | Matsuzaka et al. | 430/567 |
| 4,678,745 | 7/1987 | Yamada et al. | 430/569 |
| 4,713,323 | 12/1987 | Maskasky | 430/567 |

*Primary Examiner*—Roland E. Martin
*Assistant Examiner*—Patrick A. Doody

[57] ABSTRACT

A novel process for the preparation, for example of gelatino silver chloride and silver bromochloride grains with modified tabular crystal habit is described. These grains are prepared using standard single jet (SJ) or balanced double jet (BDJ) techniques, said preparation occurring in the presence of a modifying amount of an aminoazapyridine as defined and a suitable binder to form well-developed, sensitive tabular elements with a median grain volume in the range of 0.005 to 0.50 $\mu m^3$.

23 Claims, 4 Drawing Sheets

1 μm

1 μm

1 μm

PROCESS FOR THE PREPARATION OF TABULAR SILVER CHLORIDE EMULSIONS USING A GRAIN GROWTH MODIFIER

FIELD OF THE INVENTION

This invention relates to a new process for the preparation of a radiation-sensitive photographic silver halide emulsion. More particularly, this invention relates to a process for the preparation of a silver halide emulsion having silver halide grains wherein at least 50% of the total projected area of the total grain population are tubular in shape.

BACKGROUND OF THE INVENTION

Photographic elements made predominantly of silver chloride, with minor amounts of silver bromide and iodide, are well-known in the prior art. These elements have wide processing latitude and can be made and utilized for most of the art fields which employ silver halide as the sensitive medium. High-chloride emulsions offer the advantages of greater solubility (allowing for faster development and fixing times), and lower native sensitivity to visible light (ideal for color applications, among others) compared to other photographically useful silver halides. However, since sensitized silver chloride elements are much slower than those containing mainly bromide, their use has been generally limited to graphic arts applications, e.g., contact, low-speed camera films, and the like. It would be desirable to combine the high-speed characteristics of bromide-rich photographic emulsions with the rapid and convenient processibility of chloride-rich emulsions, a combination which is needed in many silver halide art fields.

Tabular grain silver halide products are known in the prior art and present the user with some considerable advantages over conventional grain products, e.g., those products having semi-spheroidal grains. The tabular products exhibit higher covering power, can be more effectively spectrally sensitized, are more easily developed and can tolerate a higher level of hardening without loss in covering power, each providing quite an advantage over the conventional grains.

Tabular chloride emulsions are also known and are described by Wey in U.S. Pat. No. 4,399,215, and by Maskasky, U.S. Pat. No. 4,400,463. These prior art tabular chloride emulsions are, however, not as advantageous to use since they are limited generally to large, thick tabular grains and require the use of binder supplements other than gelatin. For example, in the aforementioned Wey patent, a process for preparing extremely large, thick tabular silver chloride elements is described. The Wey process uses ammonia as a crystal growth agent and the grains produced have little utility in commercial applications. The Maskasky patent teaches the use of both a growth modifying amount of an aminoazaindene and asynthetic peptizer containing a thioether linkage, and is also limited to the preparation of large tubular silver chloride elements.

There is a need to prepare a suitable tabular grain silver halide emulsion having good speed and processing latitude, wherein at least 50 mole percent of the grains of this emulsion are chloride and are photographically useful, the emulsion being prepared without the use of a synthetic peptizer.

BRIEF DESCRIPTION OF THE DRAWINGS

In the accompanying figures forming a material part of this disclosure.

DISCLOSURE OF THE INVENTION

Figure 1:
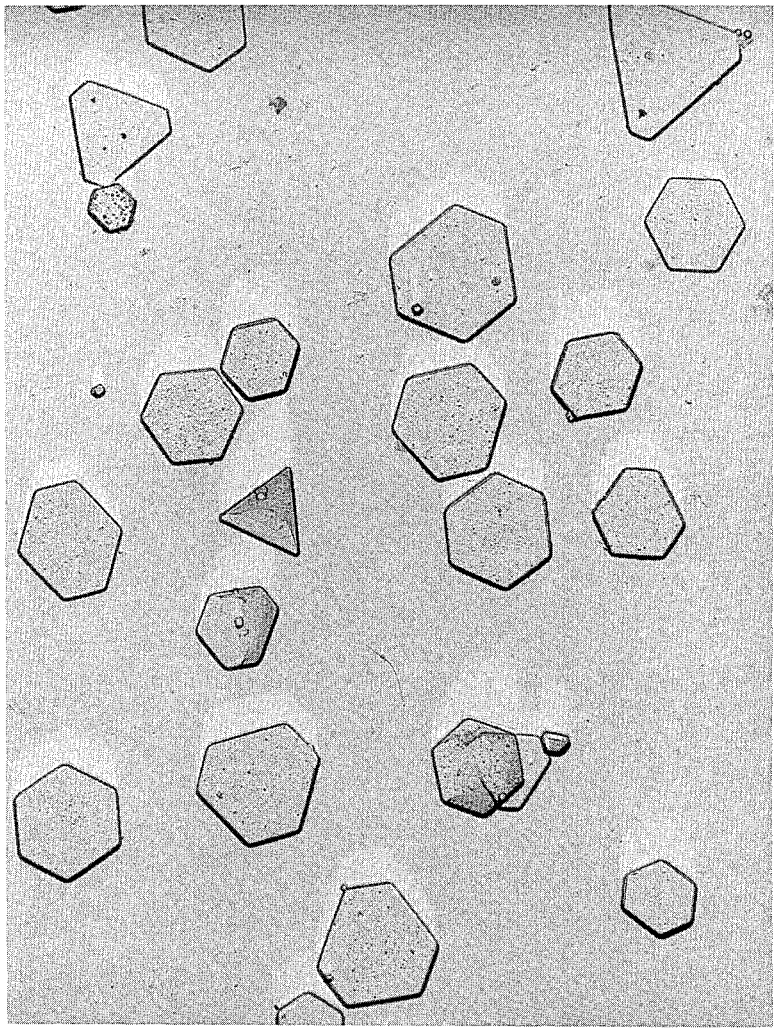
FIG. 1 is a typical electron micrograph photograph (magnification 9,800) of tabular silver bromochloride grains prepared according to Example 1 of this invention.

In accordance with this invention there is provided a process for preparing a radiation-sensitive photographic emulsion wherein aqueous silver and chloride-containing halide salt solutions are brought into contact in the presence of a dispersing medium to form silver halide grains wherein at least 50% of the total projected area of the total grain population precipitated are tabular silver halide grains having a thickness of less than 0.5 $\mu$m, an average grain volume of greater than 0.001 $\mu m^3$ and an aspect ratio of at least 2:1, and wherein the halide content of the silver halide emulsion is at least 50 mole percent chloride, based on the total moles of silver present, the improvement wherein the tabular grains are formed at a pCl in the range of 0 to 3 and a pH in the range of 2.5 to 9 in the presence of a crystal habit modifying amount of an organic nitrogen-containing compound of the following formula:

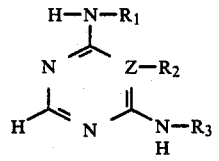

wherein Z is C or N; $R_1$, $R_2$ and $R_3$, which may be the same or different, are H or alkyl or 1 to 5 carbon atoms; when Z is C, $R_2$ and $R_3$ when taken together can be $—CR_4{=}CR_5—$ or $—CR_4{=}N—$, wherein $R_4$ and $R_5$, which may be the same or different are H or alkyl of 1 to 5 carbon atoms, with the proviso that when $R_2$ and $R_3$ taken together is said $—CR_4{=}N—$, $—CR_4{=}$ must be joined to Z; and salts thereof.

DESCRIPTION OF PREFERRED EMBODIMENTS

Throughout the specification the below-listed terms have the following meanings:

Tabular means that silver halide grains which contain chloride as the predominant halide have a thickness of less than 0.5 $\mu$m, preferably less than 0.3 $\mu$m; an average grain volume of greater than 0.001 $\mu m^3$, preferably 0.005 to 0.50 $\mu m^3$; a diameter of at least 0.2 $\mu$m; an average aspect ratio of greater than 2:1 and account for at least 50 percent of the total projected area of the predominantly chloride silver halide grains present in the emulsion.

Aspect ratio means the ratio of the diameter of the grain to its thickness.

Diameter of a grain means the diameter of a circle having an area equal to the projected area of the grain as viewed in a photomicrograph of an emulsion sample.

Projected area is used in the same sense as the terms "projection area" and "projective area" commonly employed in the art. e.g., see James and Higgins, Fundamental of Photographic Theory, Morgan and Morgan, New York, p. 15.

Average aspect ratio means the average of individual tabular grain aspect ratios.

The grain characteristics described above for the silver halide emulsions of this invention can be readily ascertained by procedures well-known to those skilled in the art. From shadowed electron micrographs, it is possible to identify those tabular grains having a thickness of less than 0.5 μm (or 0.3 μm) and a diameter of at least 0.2 μm. From this, the aspect ratio of each such tabular grain can be calculated, and the aspect ratios of all the tabular grains in the sample meeting the thickness and diameter criteria, can be averaged to obtain their average aspect ratio.

In practice it is usually simpler to obtain an average thickness and an average diameter of the tabular grains having a thickness of less than 0.5 (or 0.3) μm and a diameter of at least 0.2 μm and to calculate the average aspect ratio as the ratio of these two averages. Whether the averaged individual aspect ratios or the averages of thickness and diameter are used to determine the average aspect ratio, within the tolerances of grain measurements contemplated, the average aspect ratios obtained do not significantly differ.

A preferred method to calculate tabular grain average aspect ratio has actually been employed for this work. Specifically, the average thickness of a sample grain population is determined from shadowed electron micrographs, as described above. The average diameter, however, is determined from the average area which is in turn calculated from the ratio of the median volume-weighted grain volume (as measured independently by a conventional Electrolytic Grain size Analyzer—EGSA) and the aforementioned average grain thickness. From the average diameter and average thickness as described above, the average aspect ratio of a given tabular grain emulsion can be determined.

The projected areas of the silver halide grains meeting the thickness and diameter criteria can be summed, the projected areas of the remaining silver halide grains in the photomicrograph can be summed separately, and from the two sums the percentage of the total projected area of the silver halide grains provided by the grains meeting the thickness and diameter criteria can be calculated.

In a particularly preferred mode, silver bromochloride crystals are prepared by a standard balanced double jet (BDJ) process and are grown in the presence of gelatin and a growth modifying amount (preferably 0.06 g/1.0 mole of silver halide to 0.7 g/1.0 mole of silver halide) of 4-aminopyrazolo[3,4,d]pyrimidine at pCl 0.3 to 1.7 and pH 3.5 to 8 to produce thin, tabular $AgCl_{99}Br_1$ crystals. These crystals can be sensitized, e.g., using conventional chemical and spherical sensitizers, and coated by known techniques to produce a useful photographic element.

The emulsions of this invention are comprised mainly of silver chloride although amounts of bromide, e.g., up to 49 mole percent, may be included. Small amounts of iodide, e.g., up to 2 mole percent, may also be present. These emulsions can be made by the conventional BDJ process whereby solutions consisting essentially of the halide salt, e.g. chloride optionally containing small amounts of bromide and iodide, and one containing the silver salt are added simultaneously to a solution of gelatin in a suitable mixing vessel. Conventionally, small amounts of the halide solution may also be present in this vessel. The grain growth modifying compounds of this invention are also present in this vessel. By controlling the time the two solutions are "jetted" into the mixing vessel, and the temperature, one can generally predict the characteristics of the silver halide grains prepared therefrom. A small amount of the silver is conventionally, and preferably, added first to grow the desired seed grains. These procedures are well-known to those of normal skill in the art.

Alternatively, and also as is known in the prior art, a single-jet (SJ) procedure may be used. In this procedure, all of the desired halide is added to a suitable agitated reaction vessel along with the binding agent, e.g., gelatin, and the grain growth modifying agent of this invention. A silver salt solution, e.g., 3M $AgNO_3$, is added in one or more steps. In the first step, a portion is added at a fixed rate to form the desired crystal seeds. Then, in a subsequent step(s) the remainder is added at a somewhat faster rate to form the final grains by growing on the seed grains. The pH, of course, is maintained within the range desired, i.e., 2.5 to 9, preferably 3.5 to 8, and the temperature selected to produce the size grain desired. The tabular silver halide grains are formed at a pCl of 0 to 3, preferably 0.3 to 1.7.

The emulsions of this invention can be used in any of the conventional photographic systems, e.g., negative or positive-working systems. Thus, they can contain any of the adjuvants related to the particular system employed. For example, the emulsions when employed as direct positives may be chemically fogged using agents such as boranes, optimally in the presence of gold salts. The emulsions may contain small amounts of metal ion dopants such as rhodium, iridium, and the like, and appropriate dyes, to control contrast and sensitivity.

In the process of this invention, seeds of the desired tabular crystal shape are grown first in the presence of the growth modifying agent of this invention. Additional silver halide is then generated by a conventional BDJ process and the pH and temperature are maintained as necessary to get the desired tabular crystal size.

The tabular silver chloride and bromochloride grains of this invention are preferably grown in the presence of gelatin, though other binding materials, e.g., phthalated gelatin, etc. may also be used alone or mixed with gelatin. After the tabular grains of this invention are made, they may then be suitably dispersed in larger amounts of binder, e.g., gelatin and coated on any conventional photographic support. Paper and particularly film supports such as those made of polyethylene terephthalate suitably subbed as described by Alles, U.S. Pat. No. 2,779,689, Example IV are preferred, though other supports may also be used. The grains are preferably sensitized spectrally and chemically as is known to those skilled in the art. Filter dyes may also be present to remove unwanted light. Emulsions containing these novel grains may also contain other well-known adjuvants such as hardeners, wetting agents, antifoggants, antihalation layers, and coating aids, among others. Procedures described in Research Discloures of Product Licensing Index, December 1972, #932, p. 107 are applicable also to the emulsions of this invention.

The grain growth modifying agents useful within the ambit of this invention are based on the following, generic structure:

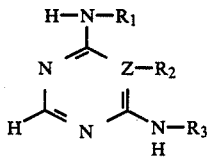

wherein Z is C or N; $R_1$, $R_2$ and $R_3$, which may be the same or different, are H or alkyl of 1 to 5 carbon atoms; when Z is C, $R_2$ and $R_3$ when taken together can be $—CR_4{=}CR_5—$ or $—CR_4{=}N—$, wherein $R_4$ and $R_5$, which may be the same or different are H or alkyl of 1 to 5 carbon atoms, with the proviso that when $R_2$ and $R_3$ taken together is said $—CR_4{=}N—$, $—CR_4{=}$ must be joined to Z; and salts thereof.

Some of the more useful compounds which fall within this generic structure include, but are not limited to:

4-aminopyrazolo[3,4,d]pyrimidine
4,6-diaminopyrimidine
2,4-diamino-1,3,5-triazine
4,6-bis(methylamino)pyrimidine In the practice of this invention, gelatin, or other binding agent, water, some of the required halide salt, and grain growth modifying agent of this invention are placed in a suitable reaction vessel. The pH is then adjusted to 2.5 to 9, preferably 3.5 to 8.0 and a suitable temperature selected, e.g., 35° C. to 75° C. Under agitation, silver salt solution, e.g., 3M $AgNO_3$ is added for a period of time to form the desired seed grains. Following this step, the remainder of the silver salt solution and a solution of the desired halide are simultaneously "jetted" into the reaction vessel. The tabular grains are "grown" during this step and are formed on the seed grains. The grains thus formed are at least 50% tabular in shape as described previously and preferably about 90% or greater have the required tabularity.

INDUSTRIAL APPLICABILITY

The emulsions from this invention can be used to prepare photographic film elements in any of the conventional areas. These films can be used, for example, in the field of X-ray, as color separation elements, as laser scanner films, or in "dry-silver" applications. When properly sensitized and treated with color-forming agents in the conventional manner, films useful as color negatives or positives can be made with the useful tabular bromochloride grains of the invention. Because of the thinness and highsolubility of the tubular high-chloride microcrystals of this invention, emulsions using these grains are ideally suited for diffusion transfer applications.

EXAMPLES

In the examples which follow, and which are used to demonstrate the efficacy and breadth of this invention without limitation and wherein the percentages are by weight, Examples 1 and 2 are considered to be preferred modes of the invention. A.R. means aspect ratio.

EXAMPLE 1

The following ingredients were placed in a suitable reaction vessel:

| Ingredients | Amount (g) |
|---|---|
| 10% aqueous gelatin | 60.0 |
| $NH_4Cl$ | 2.0 |
| 3M $NH_4Br$ | 0.25 ml |
| Deionized water | 240.0ml |
| 4-aminopyrazolo[3,4,d]pyrimidine (growth modifying agent of this invention) | 0.07 |

The pH was then adjusted with 1.5 M $H_2SO_4$ to 4.0 and the above ingredients stirred and heated to 60° C. In separate vessels, aqueous solutions of 3M $AgNO_3$ (the silver salt solution) and a mixture of aqueous 3M $NH_4Cl$ and the aforementioned $NH_4Br$ were prepared (the halide salt solution). The mixture of $Br^-$ in the $Cl^-$ was 0.5 ml of the above $NH_4Br$ solution for every 50 ml of 3M $NH_4Cl$ solution. A pump was used to meter each of these solutions into the reaction vessel. In order to generate "seed crystals" on which the remaining grains are to be grown, some of the silver salt solution was added at 1 ml/minute for 7.5 minutes (single-jet). Then, the remainder of the silver and the halide solutions were "double-jetted" (silver flow-rate adjusted to 2 ml/minute at end of single-jet seeding) into the reaction vessel in such a way as to maintain the pCl at 1.3 until 50 ml of the silver solution had been added (0.15 mole). The resulting silver halide grains ($AgCl_{98.5}Br_{1.5}$) were analyzed to determine grain size and shape. The grain volume was determined using an electrolytic grain size analyzer (EGSA) and the morphology of the grain determined first by examining the crystals under a conventional light microscope and later by transmission electron microscopy. The attached electron micrograph photograph (FIG. 1) shows excellent tabular features with an A.R. of 10.4:1, an average thickness of 0.13 μm, an average crystal diameter of 1.35 μm, and a median volume (volume-weighted) of 0.19 $\mu m^3$.

EXAMPLE 2

Figure 2:
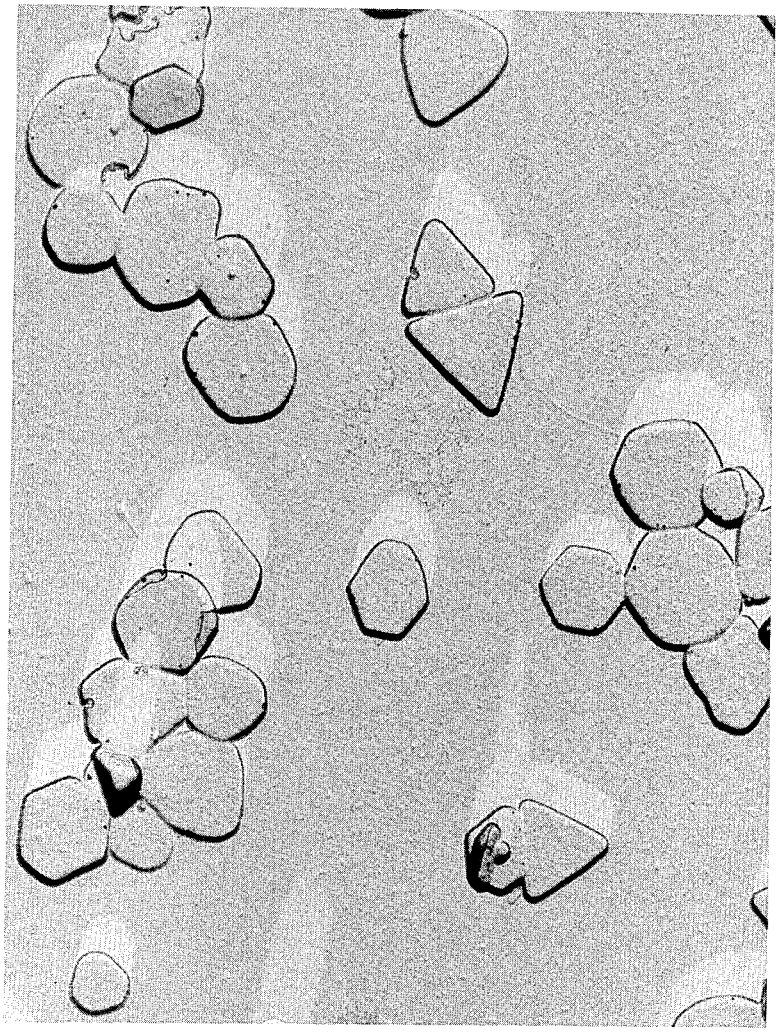
FIG. 2 is a typical electron micrograph photograph (magnification 26,600) of smaller volume tabular silver bromochloride grains prepared according to Example 2 of this invention.

In this example, smaller volume $AgCl_{98.5}Br_{1.5}$ grains were made. The basic ingredients and procedures were the same as described in Example 1 except that 0.040 g of the same growth modifying agent was used and the temperature was maintained at 40° C. This example yields tabular grains with an A.R. of 7.8:1, average thickness of 0.062 μm, an average crystal diameter of 0.48 μm, and a mediun volume of 0.011 $\mu m^3$. An electron micrograph photograph illustrating these grains is shown in FIG. 2.

EXAMPLE 3

In this example, tabular silver bromochloride grains with a composition of $AgCl_{79}Br_{21}$ were made. The reaction vessel of Example 1 containing the following ingredients was employed:

| Ingredients | Amount (g) |
|---|---|
| 10% aqueous gelatin soln. | 60.0 |
| $NH_4Cl$ | 2.0 |

-continued

| Ingredients | Amount (g) |
|---|---|
| 3M $NH_4Br$ | 1.0 ml |
| Growth mod. compd. of EX. 1 | 0.07 |
| Deionized water | 240.0 ml |

The pH was adjusted to 4.0 and the solution stirred and heated to 60° C. The halide salt mixture was changed to 10 ml of 3M $NH_4Br$ solution in 40 ml of 3M $NH_4Cl$ solution. The silver salt was added at 1 ml/minute for 2 minutes to generate seeds. Both solutions were then jetted in at 2 ml/minute while maintaining the pCl at 0.8 until 50 ml of silver solution had been added (0.15 mole). The tabular grains had an A.R. of 11.9:1, median volume of 0.15 $\mu m^3$, an average thickness of 0.11 $\mu m$, and an average crystal diameter of 1.31 $\mu m$.

EXAMPLE 4

In order to test another grain growth modifying agent of this invention, Example 1 was repeated using 0.08 g of 4,6-diaminopyrimidine hemisulfate monohydrate in place of the agent of that example. The pH was controlled at 7.00 and the pCl to 0.7. Excellent tabular $AgCl_{98.5}Br_{1.5}$ grains were grown with an A.R. of 8.8:1, median volume of 0.25 $\mu m^3$, average thickness of 0.16 $\mu m$ and average crystal diameter of 1.41 $\mu m$.

EXAMPLE 5

In this example, tabular grains of $AgCl_{89.9}Br_{9.7}I_{0.4}$ were produced. A reaction vessel similar to Example 1 was used. The following ingredients were added:

| Ingredients | Amount (g) |
|---|---|
| Bone gelatin | 60.0 |
| $NH_4Cl$ | 18.2 |
| $NH_4Br$ | 2.94 |
| 4-aminopyrazolo[3,4,d]pyrimidine | 0.81 |
| Deionized water | 1940.0 ml |

The pH was adjusted to 4.0 and the ingredients stirred and heated to 55° C. The silver salt solution was the same as that used in Example 1 but the halide salts were modified to include 100 ml of the $NH_4Br$ solution and 2.49 g of solid KI in 900 ml of the $NH_4Cl$ solution (i.e., 10% $Br^-$ and 0.5% $I^-$). Seeds were grown as previously described at 20 ml/minute for 3 minutes and then the silver and salt mixtures were jetted in to maintain a pCl of 1.1. After 20% of the silver solution had been added, the silver flow-rate was increased to twice the seeding flow-rate while still maintaining the growth chloride ion concentration. A total of 3.0 moles of silver halide was precipitated. Thin, tabular AgClBrI grains of the above composition with an A.R. of 6.4:1, mediun volume of 0.042 $\mu m^3$, an average thickness of 0.11 $\mu m$ and an average crystal diameter of 0.70 $\mu m$ were prepared.

EXAMPLE 6

In this example, yet another grain growth modifying agent was tested. The reaction vessel described in Example 1 contained the following:

| Ingredients | Amount (g) |
|---|---|
| 10% aqueous gelatin | 40.0 |
| KCl | 4.47 |
| 3M KBr soln. | 0.10 ml |

-continued

| Ingredients | Amount (g) |
|---|---|
| Deionized water | 260.0 ml |
| 4,6-bis(methylamino)pyrimidine | 0.021 |

The pH was adjusted to 7.0 and the temperature to 60° C. (with stirring). In this case, the silver and halide solutions (Example 1) were double-jetted during seeding to maintain the pCl at 0.7. After 10% of the silver had been added, the flow-rate was increased to twice the seeding flow-rate. A total of 0.15 mole of $AgCl_{99}Br_1$ tabular grains was precipitated in 27.5 minutes. These grains showed excellent tabular characteristics with an A.R. of 8.6:1, median volume of 0.13 $\mu m^3$, thickness of 0.13 $\mu m$ and an average crystal diameter of 1.12 $\mu m$.

EXAMPLE 7

In a manner similar to that previously described in Example 1, tabular $AgCl_{99}Br_1$ grains were grown using 2,4-diamino-1,3,5-triazine as the growth modifying agent. This material was present at 0.3 mole % based on total moles of silver halide to be precipitated, and the pH was controlled at 5.0 and the pCl was controlled at 1.3. Other procedures were as previously described in Example 1. Excellent tabular grains with an A.R. of 14.2:1. mediun volume of 0.21 $\mu m^3$, thickness of 0.11 $\mu m$ and an average crystal diameter of 1.56 $\mu m$ were formed.

EXAMPLE 8

In this example, a demonstration of the versatility of the process of this invention was made. Thicker tabular grains (0.2 $\mu m$ thick, A.R. 5:1) were made by lowering the concentration of growth modifying agent and increasing the pH. The following ingredients were placed in the reaction vessel of Example 1:

| Ingredients | Amount (g) |
|---|---|
| 10% aqueous gelatin | 40.0 |
| $NH_4Cl$ | 3.21 |
| 3M $NH_4Br$ | 0.25 ml |
| Growth mod. agent of Ex. 1 | 0.01 |
| Deionized water | 260.0 ml |

The pH was adjusted to 5.2 and the temperature to 60° C. (with stirring). The pCl was 0.7. Other additions at seeding and growth were similar to that described in Example 6. Excellent tabular $AgCl_{99}Br_1$ grains were obtained.

EXAMPLE 9

In order to demonstrate that an intermediate level of bromide (as compared to previous examples) can be incorporated into the tabular grains of this invention, the following ingredients were placed in the reaction vessel:

| Ingredients | Amount (g) |
|---|---|
| 10% aqueous gelatin | 400.0 |
| $NH_4Cl$ | 17.6 |
| $NH_4Br$ | 2.94 |
| Growth mod. agent of Ex. 1 | 0.41 |
| Deionized water | 1600.0 ml |

The pH was adjusted to 4.0 and the temperature to 40° C. with stirring. The silver salt solution was the same as Example 1 but the halide salt solution was 10% $NH_4Br$ in the $NH_4Cl$ solution of Example 1. 500 ml of silver solution was used. The silver salt solution was added at 10 ml/minutes during seeding and at 20 ml/minutes during growth, and the halide salt solution mixture was metered in to maintain a pCl of 1.1. Seed time was 8 minutes and total addition time was 31 minutes, 20 second. Excellent tabular $AgCl_{90}Br_{10}$ grains were made (median volume of 0.021 $\mu m^3$, thickness of 0.08 $\mu m$, diameter of 0.59 $\mu m$ and A.R. 7.7:1).

EXAMPLE 10

Pure AgCl tabular grains were made in this example. The ingredients were essentially the same as described in Example 1 except that no bromide was used. 0.04 g of the growth modifying agent was employed. The pH was 4.0, the pCl was 1.3 during growth, and the temperature maintained at 40° C. Good tabularity was observed.

CONTROL 1

Figure 3:
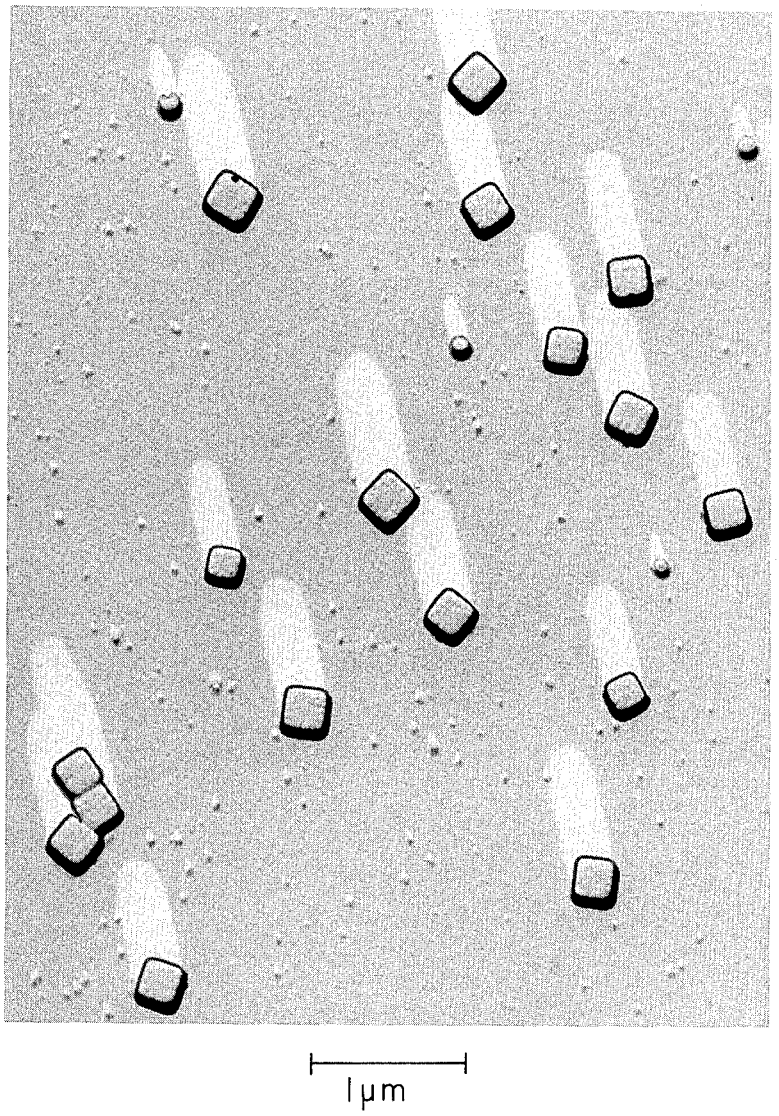
FIG. 3 (Prior Art)
FIG. 3 is a typical electron micrograph photograph (magnification 26,100) of prior art nontabular silver bromochloride grains grown without an organic nitrogen-containing compound of this invention and prepared according to Control 1.

Example 9 was repeated except that no grain growth modifying agent and a lower overall bromide stoichiometry were employed. Evaluation of the resultant 2% bromochloride emulsion showed that cubic grains had been formed (see FIG. 3).

CONTROL 2

To demonstrate that prior art grain growth modifying agents do not produce tabular grains in gelatin, the following ingredients were added to the reaction vessel:

| Ingredients | Amount (g) |
|---|---|
| 10% Aqueous Gelatin | 60.0 |
| $NH_4Cl$ | 4.8 |
| 3M $NH_4Br$ | 0.05 ml |
| Adenine (6-aminopurine) | 0.07 |
| Deionized water | 240.0 ml |

Figure 4:
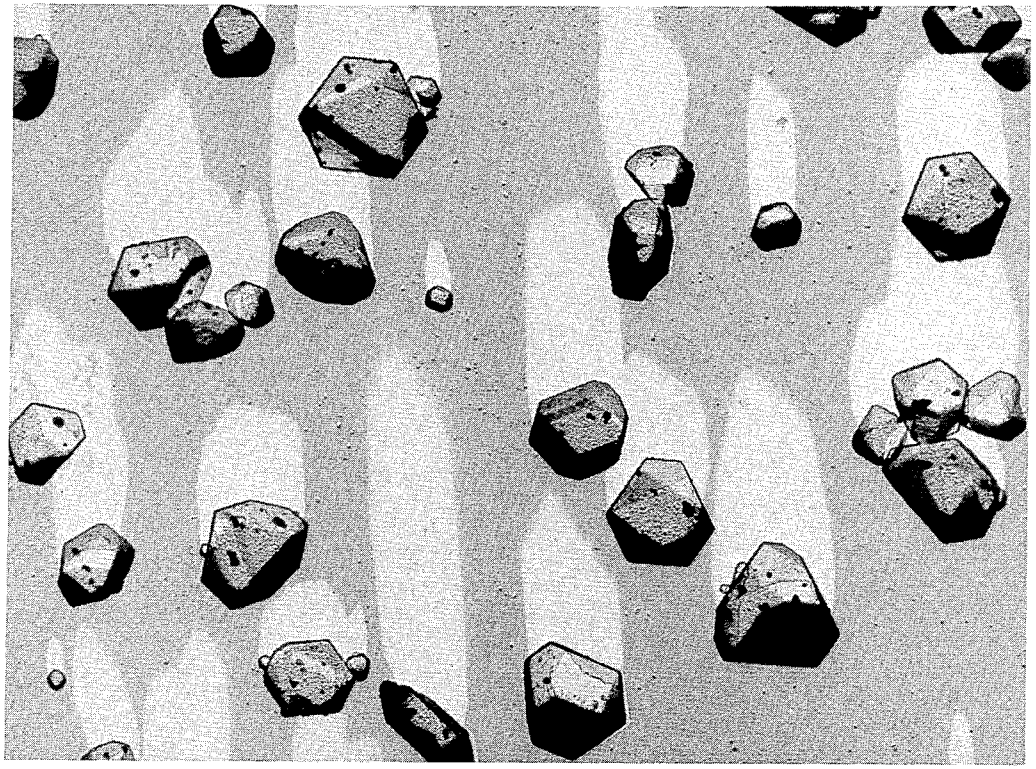
F I G. 4 (Prior Art)
FIG. 4 is a typical electron micrograph photograph (magnification 11,700) of prior art nontabular silver bromochloride grains grown in the presence of some other reported grain growth modifying compound of the prior art and prepared according to Control 2.

The pH was adjusted to 4.0 and the temperature to 60° C. with stirring. Seeding and grain growth conditions were the same as described in Example 6. The pCl was maintained at 0.7. The grains produced, however, resemble distorted octahedral and otherwise irregularly-shaped grains, and are clearly not tabular (see FIG. 4).

EXAMPLE 11

To demonstrate the utility of this invention using another binding agent, the following ingredients were charged to the reaction vessel:

| Ingredients | Amount (g) |
|---|---|
| Phthalated gelatin (Rousselot Co.) | 15.0 |
| Deionized water | 285.0 ml |
| $NH_4Cl$ | 6.0 |
| Growth mod. agent of Ex. 1 | 0.12 |

These ingredients were stirred and heated to 60° C. and the pH adjusted to 4.30–4.35. The silver salt solution (see Example 1) was added at 2 ml/minute for 4 minutes to produce the required seed grains. At this point, the remainder of the silver salt solution and a 3M aqueous $NH_4Cl$ solution were doublejetted into the vessel. After 16% of the silver had been added the silver flow-rate was increased to thrice the initial seeding rate, while maintaining the pCl at 0.5. The amount of silver halide thus precipitated was 0.45 mole. The pure chloride grains, examined as previously described, had excellent tabular shapes.

EXAMPLE 12

This example demonstrates how a single-jet process may be employed within the metes and bounds of this invention to produce a tabular, high chloride emulsion.

The following ingredients were placed in a reaction vessel:

| Ingredients | Amount (g) |
|---|---|
| 10% aqueous gelatin | 40.0 |
| Deionized water | 260.0 ml |
| KCl | 13.79 |
| 3M $NH_4Br$ | 0.50 ml |
| Grain growth mod. agent (Ex. 1) | 0.04 |

The pH was adjusted to 4.0 and the temperature to 60° C. with agitation. At this point, 5 ml of 3M $AgNO_3$ were added at 1 ml/minute. Then the silver flow rate was increased to 2 ml/minute and maintained at this level until 50 mL of the silver salt solution had been added. A total of 0.15 mole of $AgCl_{99}Br_1$emulsion was precipitated. The grains were examined as previously described and found to have good tabular characteristics.

EXAMPLE 13

In this example, a tabular high chloride silver halide emulsion ($AgCl_{97.4}Br_{2.6}$) was prepared by the process of this invention and was evaluated physically and sensitometrically. The emulsion was prepared as described in Example 1, and contained the grain growth modifying compound of that example. After the grains had been made, a sample was examined to insure that excellent, tabular grains were formed. The silver halide grains were then coagulated, the supernatant liquid was withdrawn, and the grains washed several times to remove the excess salt. The drained and washed material was then mixed in water and bulk gelatin at ca. 45° C. and pH 6.0 to redisperse the grains therein. Six portions of the emulsion thus prepared were taken. The portions were sensitized as indicated in Table 1 below and coated on a conventional polyethylene terephthalate film support that was coated, e.g., ca. 40 mg/dm$^2$, with a conventional resin sub over which had been applied a gelatin sub layer. All portions were dried, and samples of each coating were given a $10^{-2}$ flash exposure through a $\sqrt{}$ stepwedge on an EGG Sensitometer. The exposed samples were then developed for 90 seconds at 82° F. (28° C.) in a standard mixed developer (hydroquinone/phenidone), followed by 10 seconds in a conventional acid stop bath and 60 seconds in a conventional sodium thiosulfate fixer. The samples were then rinsed in water and dried.

TABLE 1

| Portion | Sensitization Technique | $D_{min}$ | Relative[a] Speed |
|---|---|---|---|
| 1 | No Sensitizers | 0.06 | 1 |
| 2 | Dye 1 only[b] | 0.06 | 1 |
| 3 | Dye 2 only[c] | 0.06 | 9 |
| 4 | Au + S only | 0.06 | 21 |
| 5 | Au, S, + Dye 1 | 0.06 | 320 |

TABLE 1-continued

| Portion | Sensitization Technique | $D_{min}$ | Relative[a] Speed |
|---|---|---|---|
| 6 | Au, S, + Dye 2 | 0.06 | 67 |

[a]As measured at 0.1 density above base plus fog.
[b]A conventional orthochromatic carbocyanine dye.
[c]A conventional blue-absorbing merocyanine dye.

The data given above clearly demonstrate that tubular high-chloride emulsions prepared by the process by this invention can be chemically and spectrally sensitized, coated and processed using conventional techniques, common to those skilled in the art.

We claim:

1. A process for preparing a radiation-sensitive photographic emulsion wherein aqueous silver and chloride-containing halide salt solutions are brought into contact in the presence of a dispersing medium to form silver halide grains wherein at least 50% of the total projected area of the total grain population precipitated are tabular silver halide grains having a thickness of less than 0.5 μm, an average grain volume of greater than 0.001 $\mu m^3$ and an aspect ratio of at least 2:1, and wherein the halide content of the silver halide emulsion is at least 50 mole percent chloride, based on the total moles of silver present, the improvement wherein the tabular grains are formed without the use of a synthetic peptizer at a pCl in the range of 0 to 3 and a pH in the range of 2.5 to 9 in the presence of a gelatin-containing dispersing medium and a crystal habit modifying amount of an organic nitrogen-containing heterocyclic compound of the following formula:

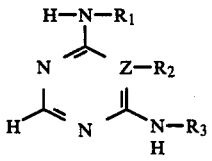

wherein Z is C or N; $R_1$, $R_2$ and $R_3$, which may be the same or different, are H or alkyl or 1 to 5 carbon atoms; when Z is C, $R_2$ and $R_3$ when taken together can be $—CR_4{=}CR_5—$ or $—CR_4{=}N—$, wherein $R_4$ and $R_5$, which may be the same or different are H or alkyl of 1 to 5 carbon atoms, with the proviso that when $R_2$ and $R_3$ taken together is said $—CR_4{=}N—$, $—CR_4{=}$ must be joined to Z; and salts thereof.

2. A process according to claim 1 wherein $R_1$, $R_2$, $R_3$, $R_4$, and $R_5$ which may be the same or different, are H or alkyl of 1 to 2 carbon atoms.

3. A process according to claim 1 wherein the organic nitrogen-containing heterocyclic compound is 4-aminopyrazolo[3,4,d]pyrimidine.

4. A process according to claim 1 wherein the organic nitrogen-containing heterocyclic compound is 4,6-diaminopyrimidine hemisulfate monohydrate.

5. A process according to claim 1 wherein the organic nitrogen-containing heterocyclic compound is 2,4-diamino-1,3,5-triazine.

6. A process according to claim 1 wherein the organic nitrogen-containing heterocyclic compound is 4,6-bis(methylamino)pyrimidine.

7. A process according to claim 1 wherein the organic nitrogen-containing heterocyclic compound is present in an amount of 0.0001 to 1.0 mole percent based on the total moles of silver present.

8. A process according to claim 1 wherein the organic nitrogen-containing heterocyclic compound is present in an amount of 0.05 of 0.5 mole percent based on the total moles of silver present.

9. A process according to claim 1 wherein the dispersing medium is gelatin.

10. A process according to claim 1 wherein the silver halide emulsion is a silver bromochloride emulsion, the bromide constituent being present in a maximum amount of 49 mole percent.

11. A process according to claim 1 wheren the silver halide emulsion is a silver iodobromochloride emulsion, the bromide and iodide constituent being present in a maximum amount of 48 and 2 mole percent, respectively.

12. A process according to claim 1 wherein the tabular grains are formed at a pCl of 0.3 to 1.7 and a pH in the range of 3.5 to 8.0.

13. A process for preparing a radiation-sensitive photographic emulsion wherein aqueous silver and chloride-containing halide salt solutions are brought into contact in the presence of a dispersing medium to form silver halide grains wherein at least 50% of the total projected area of the total grain population precipitated are tabular silver halide grains having a thickness of less than 0.5 μm, an average grain volume of greater than 0.001 $\mu m^3$ and an aspect ratio of at least 2:1, and wherein the halide content of the silver halide emulsion is at least 50 mole percent chloride, based on the total moles of silver present, the improvement wherein the tabular grains are formed without the use of a synthetic peptizer at a pCl in the range of 0 to 3 and a pH in the range of 2.5 to 9 in the presence of a gelatin-containing dispersing medium and a crystal habit modifying amount of an organic nitrogen-containing heterocyclic compound of the following formula:

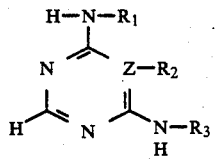

wherein Z is C or N; $R_1$, $R_2$ and $R_3$, which may be the same or different, are H or alkyl of 1 to 5 carbon atoms; and salts thereof.

14. A process according to claim 13 wherein $R_1$, $R_2$ and $R_3$, which may be the same or different, are H or alkyl of 1 to 2 carbon atoms.

15. A process according to claim 13 wherein the organic nitrogen-containing heterocyclic compound is 4,6-diaminopyrimidine hemisulfate monohydrate.

16. A process according to claim 13 wherein the organic nitrogen-containing heterocyclic compound is 2,4-diamino-1,3,5-triazine.

17. A process according to claim 13 wherein the organic nitrogen-containing heterocyclic compound is 4,6-bis(methylamino)pyrimidine.

18. A process according to claim 13 wherein the organic nitrogen-containing heterocyclic compound is present in an amount of 0.001 to 1.0 mole percent based on the total moles of silver present.

19. A process according to claim 13 wherein the organic nitrogen-containing heterocyclic compound is present in an amount of 0.05 to 0.5 mole percent based on the total moles of silver present.

20. A process according to claim 13 wherein the dispersing medium is gelatin.

21. A process according to claim 13 wherein the silver halide emulsion is a silver bromochloride emulsion, the bromide constituent being present in a maximum amount of 49 mole percent.

22. A process according to claim 13 wherein the silver halide emulsion is a silver iodobromochloride emulsion, the bromide and iodide constituent being present in a maximum amount of 48 and 2 mole percent, respectively.

23. A process according to claim 13 wherein the tabular grains are formed at a pCl or 0.3 to 1.7 and a pH in the range of 3.5 to 8.0.

* * * * *

UNITED STATES PATENT AND TRADEMARK OFFICE

CERTIFICATE OF CORRECTION

PATENT NO. : 4,804,621

DATED : FEBRUARY 14, 1989

INVENTOR(S) : THOMAS P. TUFANO/DOMINIC M. CHAN

It is certified that error appears in the above-identified patent and that said Letters Patent is hereby corrected as shown below:

Column 11, line 43, after "alkyl", "or 1 to 5" should read "of 1 to 5".

Column 12, line 11, "wherein" is misspelled.

Column 12, line 63, after "in an amount of", "0.001 to 1.0 mole" should read "0.0001 to 1.0 mole".

Column 14, line 6, after "at a pCl", "or 0.3" should read "of 0.3".

Signed and Sealed this

Fourth Day of July, 1989

*Attest:*

*Attesting Officer*

DONALD J. QUIGG

*Commissioner of Patents and Trademarks*